United States Patent [19]

Borghese et al.

[11] Patent Number: 5,033,678

[45] Date of Patent: Jul. 23, 1991

[54] OSCILLATING LAWN SPRINKLER

[75] Inventors: Alladino Borghese, Montereale Valcellina; Maria Licciardello Maranzana, Pordenone, both of Italy

[73] Assignee: Uniflex Utiltime SpA, Pordenone, Italy

[21] Appl. No.: 427,685

[22] Filed: Oct. 13, 1989

[30] Foreign Application Priority Data

Oct. 14, 1988 [IT] Italy ..... 34059/88[U]

[51] Int. Cl.[5] ..... B05B 3/16

[52] U.S. Cl. ..... 239/242

[58] Field of Search ..... 239/240, 242

[56] References Cited

U.S. PATENT DOCUMENTS

| | | | |
|---|---|---|---|
| 2,693,390 | 11/1954 | Spender et al. | 239/240 X |
| 2,942,789 | 6/1960 | Smith | 239/242 X |
| 3,105,639 | 10/1963 | Jepson | 239/242 |
| 3,559,888 | 2/1971 | Miklos . | |
| 3,630,450 | 3/1970 | Stephany | 239/242 |
| 4,232,827 | 11/1980 | Roman | 239/242 |
| 4,245,786 | 1/1981 | Abrahamsen et al. . | |
| 4,632,313 | 12/1986 | Rinkewich | 239/242 |
| 4,721,248 | 1/1988 | Chow . | |

*Primary Examiner*—Andres Kashnikow
*Assistant Examiner*—Kevin Weldon
*Attorney, Agent, or Firm*—Wenderoth, Lind & Ponack

[57] ABSTRACT

An oscillating lawn sprinkler (4) has a spray pipe (7) pivotally mounted on a sprinkler body (5). The spray pipe (7) is driven to oscillate by water pressure through a motor mechanism disposed in a driving mechanism compartment (6). The driving mechanism compartment (6) is connected to a supply of water on one side thereof and with one end of the spray pipe (7) on the other side thereof. An adjusting mechanism is provided for adjusting the flow rate of water delivered by the spray pipe. Furthermore, a mechanism for adjusting the oscillating range of the spray pipe has a control member (9) disposed on the same side of the driving mechanism compartment (6) as a control member (26) of the water flow rate adjusting mechanism. Both the control members (9, 26) are disposed on the side of the driving mechanism compartment opposite to the spray pipe (7). A filtering mechanism is removably housed at a water supply inlet connection (8) of the oscillating sprinkler (4) for filtering the supply water.

12 Claims, 3 Drawing Sheets

OSCILLATING LAWN SPRINKLER

BACKGROUND OF THE INVENTION (1) Field of the Invention

The present invention relates to an oscillating lawn sprinkler of the type which is placed freely on the ground and connected with a water supply for watering lawns, gardens, or other cultivated areas.

(2) State of the Prior Art

Oscillating lawn sprinklers are basically made up of a pipe having a number of spray apertures or nozzles therein, the pipe being pivotally mounted on a sprinkler bearing block or body and driven to oscillate by the pressure of the water going into the sprinkler. The water is conducted through a turbine-type motor enclosed in a sealed compartment, the motor then driving the spray pipe. The bearing block usually has an elongated shape with the sealed compartment mounted on one of its ends. This sealed compartment is connected with the water supply source and also serves as a driving support for at least one end of the oscillating pipe. Furthermore, mechanical control devices are provided in the sealed compartment for adjusting the range of the oscillating sprinkler to cover a desired surface area to be watered.

The above-described type of sprinkler is known from, for example, U.S. Pat. Nos. 3,559,888, 4,245,786, and 4,721,248. However, these sprinklers have the drawback of having the controls for adjusting the surface area to be sprayed by the oscillating sprinkler located at an inconvenient point on the sprinkler. Indeed, these control devices are usually mounted on the inner side of the compartment containing the driving mechanism, i.e. the side of the compartment facing the spraying pipe, just below the end of the spraying pipe.

Consequently, each time the mechanical control device needs to be adjusted, a user must turn off the water supply, move the oscillating sprinkler to a more convenient position in which the mechanical control devices can be more easily seen and accessed, adjust the mechanical control devices, replace the sprinkler in position on the ground, and finally turn the water supply back on.

The considerable inconvenience of the required procedure outlined above is further aggravated by the fact that the water supply tap is usually at a location quite remote from the oscillating sprinkler itself, requiring the user to walk back and forth repeatedly between the water supply tap and the oscillating sprinkler.

A further drawback of this type of sprinkler is that it has no mechanism for adjusting the water delivery rate to the spray pipe. Consequently, a user of the oscillating sprinkler must rely solely on adjustment of the water supply tap to adjust the water delivery rate of the oscillating sprinkler.

Again, adjustments to the oscillating sprinkler are made particularly inconvenient if the water supply tap is situated remotely from the oscillating sprinkler, or if the oscillating sprinkler is in a location which cannot be seen from the water supply tap.

Sprinklers, in general, can also be connected to water supply sources other than drinking water supply sources. For example, a sprinkler could be supplied with water from an open irrigation canal through appropriate delivery pumps. When connected in this manner, a sprinkler requires a filtering device to retain therein any particulate contaminants and foreign material which may be delivered along with the water, and which might be likely to damage the turbine-like driving mechanism of the sprinkler. A filter or strainer is usually disposed in the flow stream by being inserted in the water supply hose, at the end of the hose which is connected with the water supply intake fitting of the oscillating sprinkler. A ring nut is typically used to retain the filter or strainer in the water supply hose.

The above arrangement of the filter or strainer, however, is quite inconvenient in that the arrangement makes it difficult to clean the filtering surface when the filtering surface becomes clogged. Indeed, the filter or strainer is frequently fixed in the end fitting of the water supply hose, so that, even where the filter or strainer can be removed, it will be necessary to disassemble the entire fitting in order to be able to clean the filtering surface.

SUMMARY OF THE INVENTION

In view of the above drawbacks of the prior art, it is a principle object of the present invention to provide an oscillating sprinkler having a suitable mechanism for adjusting the water delivery rate of the sprinkler. It is a further object of the present invention to provide an oscillating sprinkler having all mechanical controls, as well as a water filtering device, arranged so as to ensure greater convenience and improved operating effectiveness in use of the oscillating sprinkler.

The above and further objects of the present invention are achieved by providing a sprinkler body having a spray pipe mounted thereon so as to be able to oscillate, a drive mechanism which receives water from a water supply, moves the spray pipe in oscillating movement in response to the water pressure of the water received from the water supply, and delivers the water to the spray pipe for discharge therethrough, and a device provided on the drive mechanism for adjusting the flow rate of the water delivered by the drive mechanism to the spray pipe.

Preferably, the spray pipe has a plurality of spray nozzles therealong for spraying discharge of water therethrough. The driving mechanism preferably comprises a compartment mounted on the sprinkler body having the spray pipe connected thereto at one end thereof. A motor moves the spray pipe in pivotable oscillating movement about a substantially horizontal axis in response to the water pressure in the compartment, and is preferably a turbine-like motor.

The oscillating sprinkler of the present invention may advantageously be provided with a mechanism in the driving mechanism compartment for adjusting the angular range of oscillation of the spray pipe. In one preferred aspect of the present invention, both the mechanism for adjusting the angular range of oscillation of the spray pipe and the adjusting device for adjusting the flow rate of water delivered to the spray pipe are provided with respective control members or knobs. The spray pipe is connected to the driving mechanism compartment on one side of the compartment, while the control members or knobs are disposed on the opposite side of the driving mechanism compartment. By disposing both the control members or knobs opposite from the spray pipe, it will be more convenient for a user of the oscillating sprinkler to adjust both the oscillating range and the water flow rate. That is, a user of the oscillating sprinkler is able to adjust the control members or knobs without reaching into the area of oscillation of the spray pipe.

In a further preferred form of the present invention, the adjusting device for adjusting the flow rate of water delivered by the spray pipe comprises a conduit member mounted in the driving mechanism compartment. This conduit member has one end in fluid communication with the spray pipe and at least one opening therein for fluid communication with the interior of the driving mechanism compartment. A valve is housed in the other end of the conduit member, and is used for throttling water flow through the opening or openings in the conduit member going from the driving mechanism compartment to the spray pipe. The control member or knob forms a part of the valve in the conduit member. The conduit member further has a retainer for retaining the valve therein and a rotation limiting feature for limiting the rotation of the valve relative to the conduit member.

Preferably, the valve comprises a stem coaxial with the conduit member, the stem having at least one valve member on an inner end thereof for throttling the opening or openings of the conduit member. A member on the stem engages the retainer of the conduit member for retaining the valve in the conduit member. The retainer of the conduit member may be an annular groove, while the member for engaging the retainer may be a collar resiliently engaging the annular groove. The rotation limiting feature may be comprised of a radial projection on the valve near the control member or knob which engages an axial projection on the interior of the conduit member.

In a further preferred feature of the present invention, the mechanism for adjusting the angular range of oscillation of the spray pipe may be connected to the conduit member by means of a flange member. Furthermore, the flange member may be integral with the conduit member.

A further preferred feature of the present invention lies in the provision of a filtering device mounted on the oscillating sprinkler. A water supply connection fitting is disposed on one end of the oscillating sprinkler and is in fluid connection with the driving mechanism compartment. Preferably, the filtering device is removably housed in the water supply connection fitting. Furthermore, the filtering device may be a cartridge-type strainer received in a counterbore of the water supply connection fitting. The provision of a filtering device at this point in the water flow stream enables quick and simple removal of debris or other material caught in the filter which may be clogging the flow stream.

BRIEF DESCRIPTION OF THE DRAWINGS

Further objects, features and characteristics of the present invention will become apparent from the following detailed description of a preferred embodiment thereof with reference to the accompanying drawings, wherein.

DESCRIPTION OF THE PREFERRED EMBODIMENT

Figure 1:
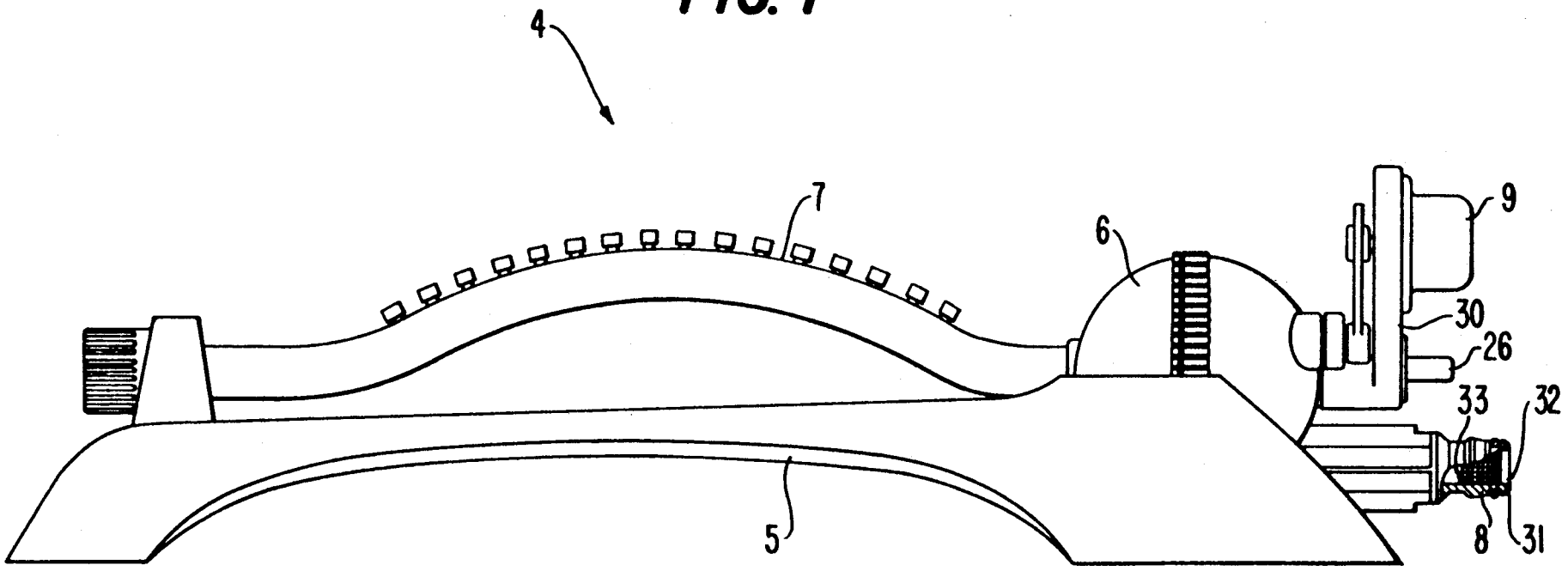
FIG. 1 is a front view of an oscillating sprinkler according to the present invention.

Referring to the figures, an oscillating sprinkler 4 has a body or block 5 for supporting or bearing a driving mechanism compartment 6 and an oscillating spray pipe 7. The driving mechanism compartment 6 is of a conventional water pressure type, including certain well known features required to operate the oscillating spray pipe 7, i.e. a turbine-like motor operated by water pressure and a mechanism for adjusting the oscillating range of the oscillating spray pipe. As these features are well known, they require no further description herein.

Water is supplied to the driving mechanism compartment 6 by a water supply inlet connection 8 disposed on a side of the driving mechanism compartment 6 facing away from the spray pipe 7. A first preferred feature of the present invention lies in the provision of a device disposed on the oscillating sprinkler itself for adjusting the water flow rate going from the water supply inlet connection 8 to the oscillating spray pipe 7. By providing a water flow adjusting device on the sprinkler, the flow of water to the spray pipe 7 can be controlled at the oscillating sprinkler itself.

As is illustrated in the preferred embodiment, the water flow adjusting device of the present invention includes a conduit member 10 mounted on the driving mechanism compartment 6. Two pipe coupling portions 11 and 12 are disposed on the driving mechanism compartment 6 for mounting the conduit member 10. In order to mount the conduit member 10 in the coupling portions 11 and 12, the conduit member is inserted axially through the coupling portions. Note in particular FIG. 3.

Figure 3:
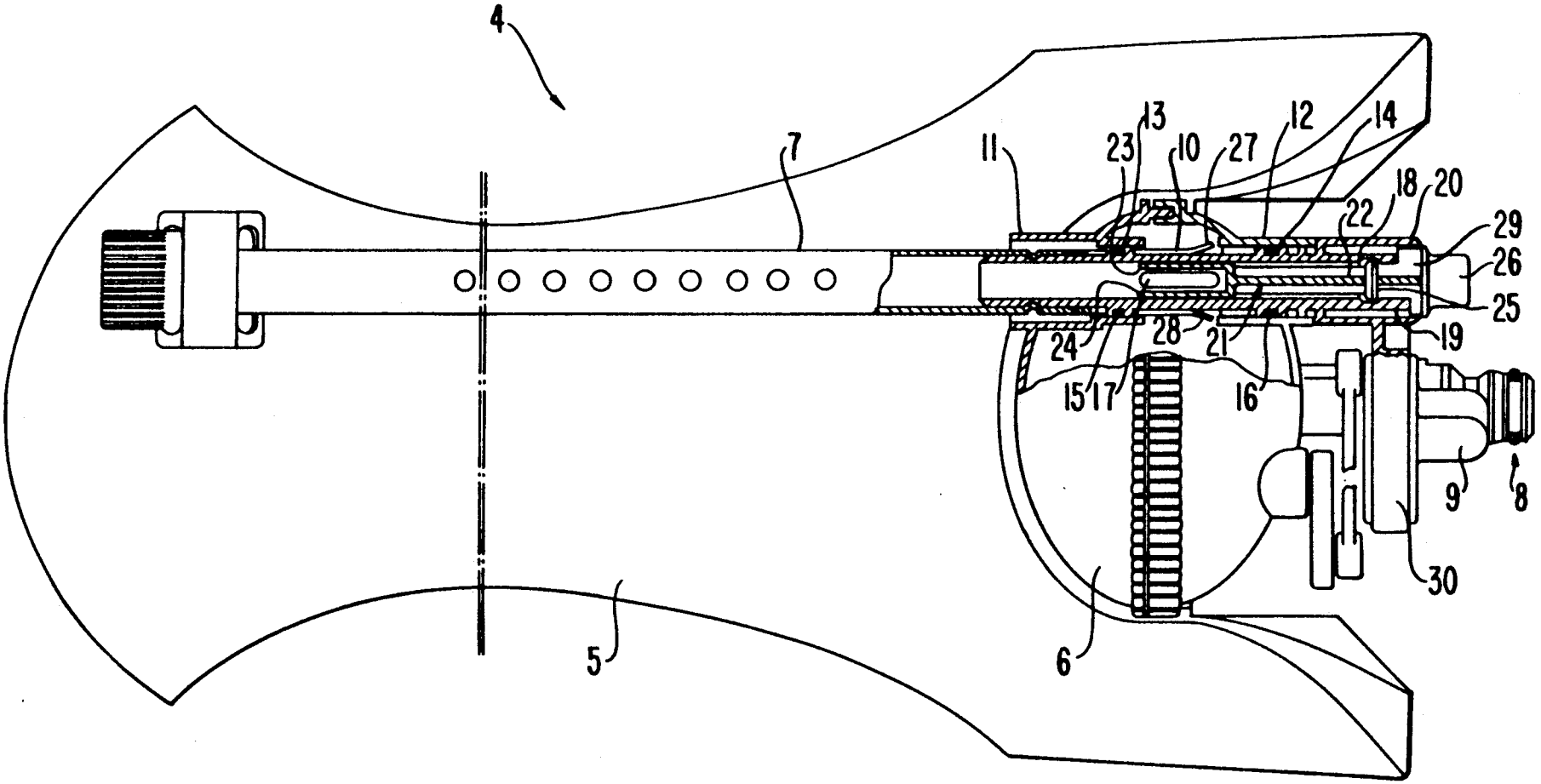
FIG. 3 is a top view of the oscillating sprinkler according to FIGS. 1 and 2.

Conduit member 10 may be provided on the outside thereof with sealing mechanisms for preventing the escape of water through the pipe couplings 11 and 12. For example, as shown in FIG. 3, annular grooves 13 and 14 are provided on the outside of the conduit member 10, and sealing rings 15 and 16 are disposed in the respective annular grooves. Between the sealing rings, in the conduit member 10, is at least one opening in the conduit member for enabling the supply water in the driving mechanism compartment 6 to enter the sleeve 10 and the spray pipe 7. Preferably, although only one opening 17 is seen in FIG. 3, two opposite openings 17 are provided in the conduit member 10. The end of the spray pipe 7 is connected to the end of the conduit member 10 by a pressure fitting.

The water flow adjusting device further has disposed in the conduit member 10 a valve 21 for controlling or throttling the flow of water from the driving mechanism compartment 6 to the spray pipe 7. The valve 21 comprises a stem 22 which has, on an inner end thereof, at least one, and preferably two, valving members or tabs 23 and 24 for throttling the flow of water through the opening or openings 17. A control member or knob 26 for adjusting the position of the valve members 23 and 24 is provided on the other end of the valve stem 22.

In a preferred feature of the present invention a control member or knob 9 of the mechanism for adjusting the oscillating range of the sprinkler is disposed on the driving mechanism compartment 6 on the side of the compartment 6 opposite the spray pipe 7. The control member or knob 26, as can be seen from FIG. 3, also faces away from the spray pipe 7, being disposed on the same side of the driving mechanism compartment 6 as the control knob 9 of the oscillation adjusting mechanism. This arrangement enables convenient access to the controls of the oscillating sprinkler.

An arrangement is also provided for retaining the valve 21 within the conduit member 10. Preferably, the valve 21 resiliently engages the interior of the conduit member 10 to hold the valve therein. More specifically, the conduit member 10 may be provided with an inner annular groove 18 while the valve 21 is provided with a collar 25 for resilient engagement with the inner annular groove 18. To mount the valve 21 in the conduit member, the valve 21 is simply moved into the conduit member 10 from its outer end until the collar 25 snaps into and resiliently engages the groove 18.

A mechanism is also provided for limiting the rotation of the valve 21 relative to the conduit member 10. Preferably, a stop is provided to physically prevent the rotation of the valve 21 on the interior of the conduit member 10 beyond a certain point. More specifically, an axial projection 19, as seen in FIG. 3, projects from the conduit member 10 as an integral extension thereof. A radial projection 29 is provided on the valve 21 adjacent the control member or knob 26. The radial projection 29 will strike against the longitudinal edges of the axial projection 19 of the conduit member 10, limiting the rotation of the valve 21. The axial projection 19 thus forms two positive limit stops for the valve 21.

The conduit member 10 may be retained in the driving mechanism compartment 6, between the pipe couplings 11 and 12, it should be noted, by a pair of spring tabs 27 and 28. When the conduit member 10 is inserted into the couplings 11 and 12, the spring tabs 27 and 28 are pressed inwardly to allow the conduit member 10 to be moved into position. Once in position, the spring tabs 27 and 28 spring outwards to prevent removal of the conduit member 10 by engagement of the spring tabs 27 and 28 with the pipe coupling 12. The radial extent of a cylindrical housing 20 on the end of the conduit member 10 prevents further inward movement of the conduit member 10 into the pipe couplings 11 and 12. Thus it can be seen that the conduit member 10 is securely fixed in place inside the driving mechanism compartment 6 and the pipe couplings 11 and 12. If the valve 21 is pressed into the sleeve 10, or attempted to be removed, the sleeve 10 will be held securely in place and accidental removal will be prevented.

The valve members or tabs 23 and 24 of the valve 21 may have a surface which is tapered toward their respective free ends, in order to provide for small flow rate variations in the adjustment of the valve. Through the adjustment of the control member or knob 26, the valve members 23 and 24 can be rotated between a fully open position for maximum water supply to the spray pipe 7 and a minimum flow rate position for a minimum water flow rate to the spray pipe 7. The axial projection 19 and the corresponding radial projection 29 can be designed in such a manner so as to provide positive limit stops at these respective positions, whereby a user can simply and easily rotate the control knob 26 between the two stop positions.

As has been discussed above, the mechanism which is provided for adjusting the oscillating range of the spray pipe 7 is basically of a conventional type. However, the present invention provides the feature of disposing the controls for the oscillating range adjusting mechanism on a side of the driving mechanism compartment 6 opposite to the side whereat the spray pipe 7 is connected. Furthermore, the present invention also now contemplates structurally linking the control for the oscillating adjusting mechanism with the conduit member 10. In this respect, note FIG. 2. Control member or knob 9 of the oscillating range adjusting mechanism is surrounded by a flange 30 structurally connected to the conduit member 10. Preferably, the flange 30 is integral with the conduit member 10. Noting FIG. 3, in one preferred form the flange 30 is integral with the cylindrical housing 20 of the conduit member 10.

In a further preferred feature of the present invention, in addition to the advantages which result from the provision of a mechanism for adjusting the flow rate of the water supplied to the spray pipe 7 and arranging the controls for both the flow rate adjusting mechanism and the oscillating range adjusting mechanism on the outer, i.e. more easily accessible, side of the driving mechanism compartment 6, the oscillating sprinkler of the present invention may be provided with a water filtering device. Preferably, a water filtering device may be disposed inside the water supply inlet connection 8 for filtering water from a water supply hose.

The water supply inlet connection 8 may be either a male or a female type of connection, but in the described embodiment of the oscillating sprinkler according to the present invention, the water supply inlet connection 8 is shown as a male-type connection fitting (see FIG. 3). The connection 8 is snapped fitted into a corresponding female-type fitting, which is provided on the end of a water supply hose (not shown).

Figure 2:
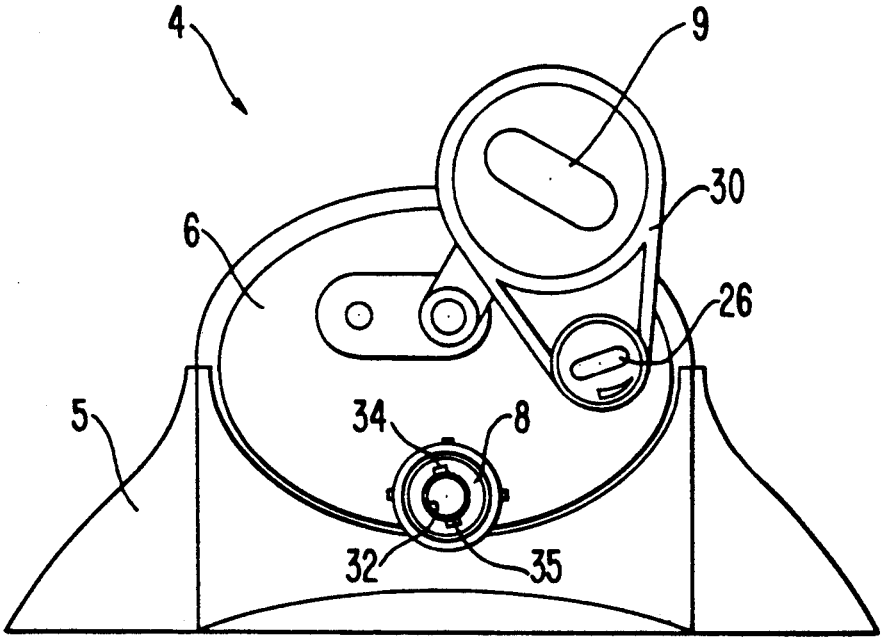
FIG. 2 is a side view of the oscillating sprinkler according to FIG. 1.

On the inside of the connection 8, as shown in FIGS. 1 and 2 most clearly, is provided an arrangement for removably mounting an appropriate filtering mechanism therein. By having an easily removable filtering mechanism disposed in the connection 8 of the oscillating sprinkler 4, a user of the oscillating sprinkler 4 can easily and quickly remove debris or material which has accumulated in the filtering mechanism. Preferably, the filtering mechanism is a cartridge strainer 33 mounted in but easily removable from the connection 8. A counterbore 31 is provided on the interior of the water supply inlet connection 8. This counterbore 31 is provided for receiving an edge 32 of the cartridge strainer 33 thereagainst (see FIG. 1).

Noting FIG. 2, two longitudinal bevel cuts 34 and 35 may be provided on the inner surface of the water supply inlet connection 8. These bevel cuts 34 and 35 allow for easy removal of the filtering cartridge 33 from the inlet connection 8. A suitably pointed tool is simply inserted into the one of the bevel cuts to remove the cartridge strainer 33.

Thus it can be seen that, with the filtering arrangement of the present invention, the use of an oscillating sprinkler can have the advantage of a filtering mechanism for preventing the clogging of the mechanism of the sprinkler while at the same time being able to quickly and easily remove the filtering mechanism for cleaning. This is achieved by the above described arrangement of the filtering mechanism being disposed on the oscillating sprinkler itself, in the water supply inlet connection.

From the above description of the oscillating sprinkler of the present invention as a whole, it can be seen that a much more convenient and easy to use oscillating sprinkler is achieved by the provision of a device for adjusting the water supply flow rate on the oscillating sprinkler itself. This is further achieved by the arrangement of all user controls at a more convenient and easily accessible location on the oscillating sprinkler. This is further achieved by the provision of a water filtering arrangement provided independently of any parts or components outside of the sprinkler itself and which is easily removable and cleanable from the oscillating sprinkler.

Although the present invention has been described and illustrated with respect to preferred features thereof, it is to be understood that various modifications and changes may be made to the specifically described and illustrated features without departing from the scope of the present invention.

We claim:

1. An oscillating sprinkler body, comprising:

a sprinkler body;

a spray pipe having a plurality of spray apertures therealong pivotably mounted on said sprinkler body for pivoting movement about a substantially horizontal axis;

a driving mechanism compartment mounted on said sprinkler body having a water supply connection fitting on one side thereof, said compartment being fluidly connected to said spray pipe on the opposite side of said compartment, and said compartment having a motor therein for moving said spray pipe in pivotable oscillating movement about said substantially horizontal axis in response to water pressure in said compartment; and valve means for adjusting the water flow rate of water flowing from said compartment to said spray pipe, said valve means being disposed in said compartment downstream of said motor, and said valve means comprising a conduit member mounted on said driving mechanism compartment having one end thereof in fluid communication with said spray pipe and at least one opening therein for fluid communication with the interior of said driving mechanism compartment, and a valve coaxial with said conduit member and said spray pipe rotatably mounted inside said conduit member for throttling the water flow through said at least one opening.

2. The oscillating sprinkler as set forth in claim 1, wherein:

said conduit member further comprises at the other end thereof a retainer for retaining said valve therein and a rotation limiting means for limiting rotation of said valve relative to said conduit member; and said valve comprises a stem coaxial with said conduit member, at least one valve member on an inner end of said stem for throttling said at least one opening in said conduit member, means on an outer end of said stem for engaging said retainer of said conduit member to retain said stem therein, and an actuation means on said outer end of said stem for rotatably actuating said valve and engaging with said rotation limiting means of said conduit member for limiting rotation of said valve relative to said conduit member.

3. The oscillating sprinkler as set forth in claim 2, wherein:

said means for engaging comprises a collar for resiliently engaging said retainer of said conduit member;

said retaining comprises an annular groove machined on the interior of said conduit member;

said actuation means comprises a knob having a radial projection for engaging said rotation limiting means to limit the angle of rotation of said valve; and said rotation limiting means comprises an axial projection inside said conduit member.

4. The oscillating sprinkler as set forth in claim 2, wherein each said at least one valve member of said valve has a tapered surface.

5. An oscillating sprinkler body, comprising:

an elongated sprinkler body having opposite ends;

a spray pipe having a plurality of spray apertures therealong pivotably mounted on said sprinkler body at both said opposite ends thereof for pivoting movement about a horizontal axis;

a driving mechanism compartment mounted on one of said opposite ends of said elongated sprinkler body, said driving mechanism compartment having opposite sides, one side facing toward the other opposite end of said elongated sprinkler body and the other side facing away from said spray pipe;

means for mounting said spray pipe to said compartment such that said spray pipe is pivotable relative to said compartment and in fluid communication with the interior of said compartment so as to receive water flowing therefrom;

a motor in said compartment for moving said spray pipe in pivotable oscillating movement about said longitudinal axis in response to water pressure therein;

a fitting disposed on said other side of said compartment for admitting water into said compartment;

valve means for adjusting the water flow rate of water flowing from said compartment to said spray pipe, said valve means having a manual control member; and means in said driving mechanism compartment for adjusting the angular range of oscillation of said spray pipe, said means having a manual control member;

wherein both said manual control members are disposed on the exterior of said compartment on said other side thereof such that both said manual control members are positioned opposite to said spray pipe with respect to said compartment.

6. The oscillating sprinkler as set forth in claim 5, wherein said valve means is disposed downstream of said motor on said compartment.

7. The oscillating sprinkler as set forth in claim 6, wherein said valve means comprises:

a conduit member mounted on said driving mechanism compartment having one end thereof in fluid communication with said spray pipe and at least one opening therein for fluid communication with the interior of said driving mechanism compartment; and a valve coaxial with said conduit member and said spray pipe rotatably mounted inside said conduit member for throttling the water flow through said at least one opening.

8. The oscillating sprinkler as set forth in claim 7, wherein:

said conduit member further comprises at the other end thereof a retainer for retaining said valve therein and a rotation limiting means for limiting rotation of said valve relative to said conduit member; and said valve comprises a stem coaxial with said conduit member, at least one valve member on an inner end of said stem for throttling said at least one opening in said conduit member, means on an outer end of said stem for engaging said retainer of said conduit member to retain said stem therein, and an actuation means on said outer end of said stem for rotatably actuating said valve and engaging with said rotation limiting means of said conduit member for limiting rotation of said valve relative to said conduit member.

9. The oscillating sprinkler as set forth in claim 8, wherein:

said means for engaging comprises a collar for resiliently engaging said retainer of said conduit member;

said retainer comprises an annular groove machined on the interior of said conduit member;

said actuation means comprises a knob having a radial projection for engaging said rotation limiting means to limit the angle of rotation of said valve; and said rotation limiting means comprises an axial projection inside said conduit member.

10. The oscillating sprinkler as set forth in claim 9, wherein said at least one valve member of said valve has a tapered surface.

11. The oscillating sprinkler as set forth in claim 5, and further comprising a cartridge filter and means in said fitting for removably mounting said cartridge filter therein such that said cartridge filter can be removed from said fitting without disassembling said fitting.

12. An oscillating sprinkler, comprising:

a sprinkler body;

a spray pipe pivotably movably mounted on said sprinkler body;

a water supply connection for supplying water to said spray pipe;

drive means for receiving water from said water supply connection, moving said spray pipe in oscillating movement in response to the water pressure of water received from said water supply connection, and delivering water from said water supply connection to said spray pipe; and an adjusting means on said drive means for adjusting the flow rate of water delivered by said drive means to said spray pipe;

wherein said adjusting means has an adjustment control on one side of said drive means;

wherein a spray pipe range adjusting means is disposed on said drive means for adjusting the angular range of oscillation of said spray pipe, said spray pipe range adjusting means having a control on said one side of said drive means;

wherein said water supply connection is disposed on said one side; and wherein said spray pipe is disposed on a side of said drive means opposite to said one side.

* * * * *